US008100189B2

(12) United States Patent
Edvardson et al.

(10) Patent No.: US 8,100,189 B2
(45) Date of Patent: Jan. 24, 2012

(54) SYSTEM AND METHOD FOR DYNAMIC SEALING OF A DRILL STRING

(75) Inventors: Per Espen Edvardson, Fyllingsdalen (NO); Tom Kjetil Askeland, Straume (NO)

(73) Assignee: Siem Wis AS, Knarrevik (NO)

( * ) Notice: Subject to any disclaimer, the term of this patent is extended or adjusted under 35 U.S.C. 154(b) by 568 days.

(21) Appl. No.: 11/988,524

(22) PCT Filed: Jul. 12, 2006

(86) PCT No.: PCT/NP2006/000272

§ 371 (c)(1),
(2), (4) Date: Jan. 12, 2009

(87) PCT Pub. No.: WO2007/008085

PCT Pub. Date: Jan. 18, 2007

(65) Prior Publication Data

US 2009/0166046 A1 Jul. 2, 2009

(30) Foreign Application Priority Data

Jul. 13, 2005 (NO) ..... 20053394

(51) Int. Cl.
*E21B 19/00* (2006.01)

(52) U.S. Cl. ..... 166/387; 166/84.4

(58) Field of Classification Search ..... 166/387, 166/84.4, 84.2

See application file for complete search history.

(56) References Cited

U.S. PATENT DOCUMENTS

| | | | | |
|---|---|---|---|---|
| 1,875,632 | A * | 9/1932 | McEvoy | 277/343 |
| 2,222,082 | A * | 11/1940 | Leman et al. | 175/195 |
| 3,387,851 | A * | 6/1968 | Cugini | 277/318 |
| 3,474,858 | A | 10/1969 | Gibson et al. | |
| 3,965,987 | A * | 6/1976 | Biffle | 166/379 |
| 4,149,603 | A | 4/1979 | Arnold | |
| 6,325,159 | B1 * | 12/2001 | Peterman et al. | 175/7 |
| 7,258,171 | B2 * | 8/2007 | Bourgoyne et al. | 166/382 |
| 7,779,903 | B2 * | 8/2010 | Bailey et al. | 166/84.4 |
| 2005/0061499 | A1 * | 3/2005 | Hopper | 166/84.3 |
| 2006/0037782 | A1 * | 2/2006 | Martin-Marshall | 175/40 |
| 2010/0147525 | A1 * | 6/2010 | Lerner et al. | 166/332.1 |
| 2010/0175882 | A1 * | 7/2010 | Bailey et al. | 166/335 |

FOREIGN PATENT DOCUMENTS

NO 317227 B1 9/2004

OTHER PUBLICATIONS

International Search Report dated Oct. 31, 2006 for International Application No. PCT/NO2006/000272.
Written Opinion of the International Searching Authority dated Oct. 31, 2006 for International Application No. PCT/NO2006/000272.

* cited by examiner

*Primary Examiner* — Daniel P Stephenson
(74) *Attorney, Agent, or Firm* — Kilpatrick Townsend & Stockton LLP

(57) ABSTRACT

A system and a method are described for a dynamic seal around a drill stem that moves into or out of water carrying, drilling fluid carrying or hydrocarbon carrying wells. The sealing arrangement (10) comprises an elongated sealing unit (30) that is arranged to envelop the drill stem (16), and a receiver unit (40) that is mounted to said existing equipment on the well and which is arranged to receive the elongated sealing unit (30), and that internal pressure support is provided in the sealing arrangement, at least corresponding to the surrounding pressure, to provide a dynamic seal around the drill stem (16).

8 Claims, 4 Drawing Sheets

SYSTEM AND METHOD FOR DYNAMIC SEALING OF A DRILL STRING

The present invention relates to a system and a method for dynamic sealing around a drill stem of variable diameter, in water carrying, drilling fluid carrying or hydrocarbon carrying wells, comprising a sealing arrangement arranged to be mounted to existing equipment on the well and for use without a riser or a landing string being mounted, where the sealing arrangement comprises an elongated, dynamic sealing unit that is arranged to surround the drill stem, and a receiver unit that is mounted to said existing equipment on the well and which is arranged to receive the sealing unit.

The invention can be used to seal around a drill stem or coil pipe that is moving into, or out of, oil wells and gas wells in all water carrying, drilling fluid carrying or hydrocarbon carrying types of wells, both wells that have a valve tree (well safety valves) placed on an ocean bottom, a platform, a vessel, an installation or on land.

The invention relates to systems and methods that make it possible to intervene and drill in the above mentioned water carrying, drilling fluid carrying or hydrocarbon carrying wells, and especially for ocean bottom based wells, both with and without using a riser connection to a surface vessel or another installation. The system and the method cover working the above mentioned water carrying, drilling fluid carrying or hydrocarbon carrying wells carried out with the help of a drill stem, snubbing stem and coil pipe, and also said methods based on use of new composite and thermoplastic materials and also complimentary solutions. Drill stem, snubbing stem and coil tubing are mentioned hereafter under the designation drill stem. Understood with the expression downhole tools must be different tools for operation in a well, i.e. equipment for drilling operations, equipment for intervention, equipment for logging, measuring, fishing etc.

The invention will, in a simplified way, represent a dynamic seal around a drill stem that moves into or out of, water carrying, drilling fluid carrying or hydrocarbon carrying wells. The invention concerns both situations where the well pressure is higher and lower than the surrounding pressure at the valve tree. This leads to the invention being able to withstand pressure from both sides during operation and testing.

The invention will be especially suited to operations that involve drilling through existing production pipes in a well, in this case ocean bottom based wells where the invention, together with other systems, will be able to contribute to remove the riser connection to a surface vessel or another installation.

Today's methods to carry out well interventions or drilling in ocean bottom installed wells with the help of a drill stem or a coiled pipe, are based on using a riser connection between the wellhead and the surface equipment on the surface vessel or installation. This requires a large, and thereby costly, surface vessel or other installation that must have a space on the blowout preventer for the riser, a riser for the ocean depth where the work is carried out, and also other equipment that is required for pressure control and stand-by handling.

Today there are systems for dynamic sealing, where pressure from one side is used. One of the challenges with the existing, dynamic seal functions is their limitation with respect to friction that must be overcome to move the drill stem into or out of the well, and also the complexity of many moving parts. Furthermore, NO 317227 and U.S. Pat. No. 6,386,290 shall be highlighted as examples of prior art. The former represents the closest technology and relates to a lubricant for use on a wellhead, where the lubricant has sealants that seal around a coiled pipe and which has inner pressure support.

The present invention aims to make it possible to carry out a more flexible and cheap well intervention and drilling operation, by combining existing and new technology through new methods and systems.

The system with associated equipment has, in the main, one main configuration, and this will be adapted to the outer diameter of the stem that shall pass through the seal.

The present system for dynamic sealing around a drill stem in water carrying, drilling fluid carrying or hydrocarbon carrying wells comprises a sealing arrangement mounted onto other equipment and adjoining systems that are required to carry out the operation in the well, whether it is an ocean bottom based well or a surface well, where the sealing arrangement is a sealant that can be collected and regulated/controlled for well intervention with the help of a drill stem, and where the degree of sealing for the seal to seal between the well and drill stem can be adjusted. The seal can resist pressure from both sides, and thus prevent that the well medium flows out to the surroundings or that the surrounding medium flows into the well.

Furthermore, grease or oil can be injected with high pressure into the seal between the sealing sets to provide pressure support to the sealing sets, and/or to prevent through flow of fluid or gases in the seal, and/or to reduce the friction between seal and drill stem.

With the present invention, the drill stem can move into, or out of, the well with maximum well pressure. The system is preferably controlled and connected to a suitable control system.

A preferred embodiment of the system according to the invention has an internal pressure support that is provided in the sealing arrangement, at least corresponding to the surrounding pressure, to provide a dynamic seal around the drill stem, and also that the sealing unit comprises a number of sets with main seals arranged mutually spaced apart further than the length on the pipe coupling in the drill stem, in the longitudinal direction of the sealing unit.

Alternative, preferred embodiments of the system are characterised by each of said sealing sets can comprise at least one dish-formed or ring-formed packing element of an elastic material, such as an elastomeric material, arranged to envelop the drill stem. An elongated annular space is preferably provided between the sets with sealing elements, in the longitudinal direction, arranged to receive an injected pressure medium, such as grease or oil, where the pressure medium is injected at a pressure that is preferably higher than the highest pressure that surround the sealing arrangement from the well or the surroundings. Furthermore, a number of seals, such as elastomer seals, can be arranged between the sealing unit and the receiver part.

A preferred embodiment of the method according to the invention is characterised by a pressure medium that is injected into a defined annular space that lies between a number of sealing sets in the sealing arrangement, to provide internal pressure support, at least corresponding to the surrounding pressure, that can be adjusted in the degree of sealing to seal between the well and the drill stem. Alternative preferred embodiments of the method are characterised by the pressure medium that is injected in said annular space is grease, oil or another medium with a high pressure, to give pressure support to the sealing arrangement so that this resists pressure from both sides, thus to both prevent well medium from flowing out into the environment or that the surrounding medium flows into the well. Furthermore, the grease or oil injected between the sealing sets prevents through flow of fluid or gases in the sealing arrangement and/or reduces the friction between the sealing sets and the drill stem.

In connection with drilling operations in wells with the help of a drill stem, necessary complimentary systems will be used to maintain other functions that are required to carry out the operation (cutting functions and sealing functions, disconnecting systems, drilling fluid systems, etc.). Power supply to the drill stem (snubbing) will be taken care of by other systems according to need. This invention encompasses only the dynamic sealing function with its unique associated systems.

The invention does not take into consideration how the tool and the stem that shall go into the well are operated or driven, and as such covers any form of such methods.

The invention shall now be described further with reference to the enclosed figures, in which.

In the following, different embodiment examples shall be described, but it must be understood that other likely configurations are also possible within the framework of the invention.

Figure 1:
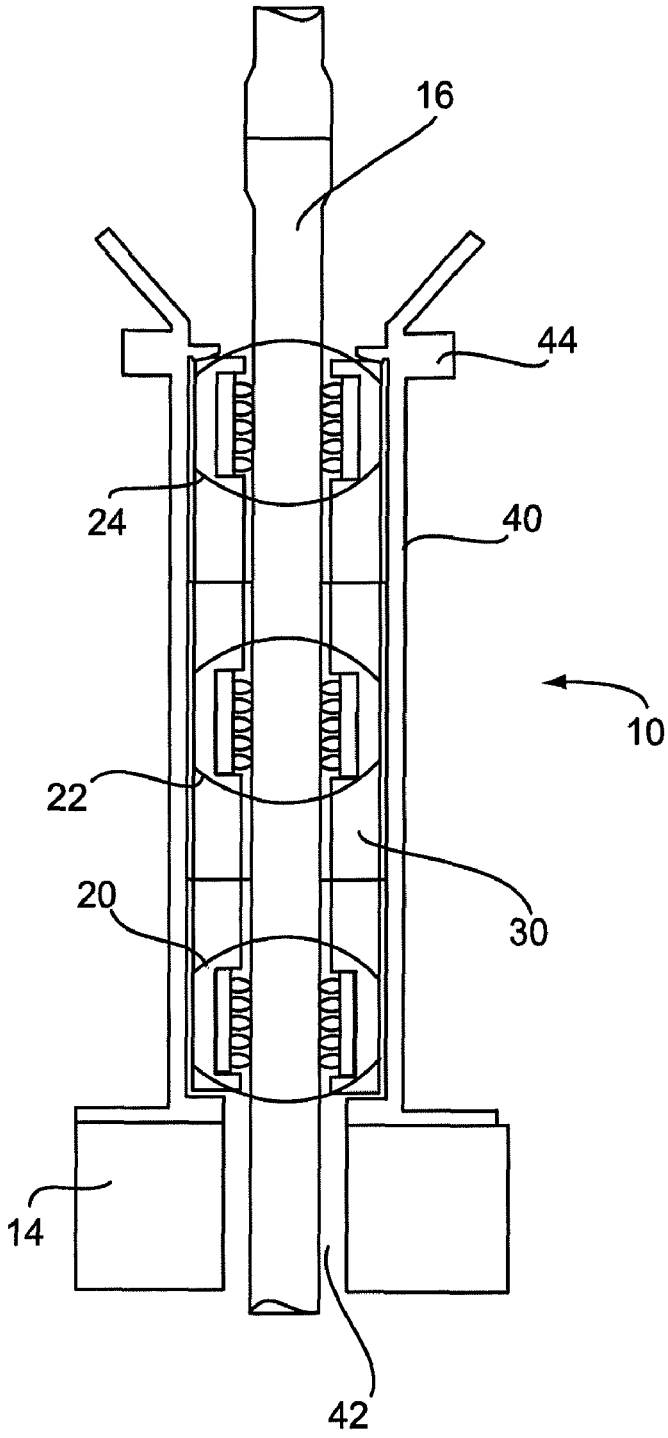
FIG. 1 shows an embodiment of the present invention situated on the top of an imagined configuration in connection with a drilling operation.

The configuration and the system can be used independently of whether the valve tree is localised on the ocean bottom or is available on the surface/ashore. The system refers to FIG. 1, and shows an embodiment of the present system localised on top of an imagined configuration in connection with a drilling operation. The system comprises, in the main, a well blowout preventer system 14 for use during drilling and a dynamic sealing arrangement 10. The dynamic sealing arrangement 10 is placed uppermost in the configuration and will maintain pressure control during drilling or intervention work. The sealing arrangement 10 shall be able to withstand pressure from both sides, but preferably higher pressure from the well side than from the pressure of the surroundings.

The method for driving a drill stem 16 into a pressurised well by using the dynamic sealing arrangement 10 is as follows. The drill stem 16 goes into or out of the well (both for overpressure and underpressure, and also pressure balance) through the dynamic seal 10 that is mounted uppermost on the temporary blowout preventer equipment 14. The drill stem 16 passes preferably three sets of sealing elements 20,22,24 when it is moved. The sealing elements 20,22,24 are placed with a mutual distance apart that leads to that preferably only one of the sealing elements will be exposed to one pipe coupling in the drill stem 16 at any time. Between the sealing elements, preferably environmentally friendly grease or oil is injected with a pressure that exceeds the highest external pressure with typically 5-100 bar. The sealing elements will, in this way, get pressure support to be able to withstand a higher external pressure, and also get lubrication that will reduce the friction against the drill stem. The drill stem is driven into the well with the help of the weight of the downhole tool, and also any forces exerted from external methods and systems.

Figure 2:
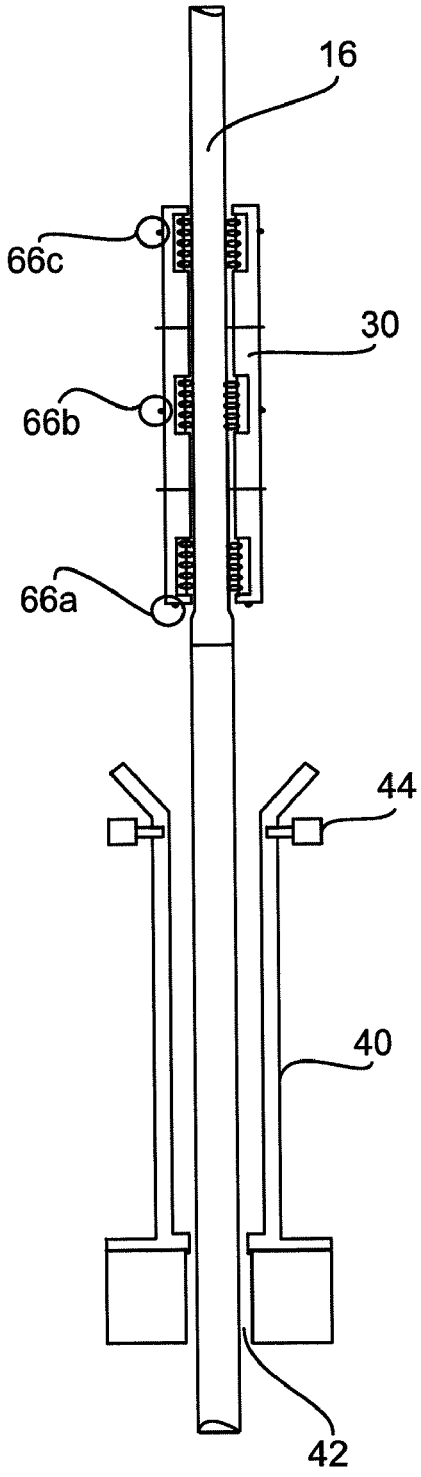
FIG. 2 shows the operation of the present system situated on the top of an imagined tool string on its way into, or out of, the well.

FIG. 2 shows installation and collection of the present system, localised hanging on an imagined tool string in connection with a drilling operation. The system that it refers to in FIG. 2 shows an inner, dynamic (elongated), sealing unit 30 driven on a drill/intervention stem 16 and a receiver unit 40 localised on the already installed equipment on the ocean bottom. As can be seen, the inner, dynamic (elongated), sealing unit 30 and the receiver unit 40 will make up the sealing arrangement 10 when the units are mounted together.

The method for installing and collecting the dynamic sealing unit is as follows. After the downhole tool is made up on the surface, the dynamic sealing unit 30 is mounted preferably on the first regular drill stem 16. Thereafter, the drill stem with tool is driven into a well lock underneath the receiver unit 40, until the dynamic sealing unit 30 engages with the receiver unit 40 that is mounted to the blowout preventer equipment. The sealing unit 30 is locked mechanically to the receiver part and is tested. The locking can, for example, be carried out with a hydraulic locking unit 44 in the upper part of the receiver unit 40. Furthermore, a number of seals of elastomers 66*a*-66*c* will be arranged between the sealing unit 30 and the receiver unit 40, to prevent through flow of fluid/gas.

Figure 3:
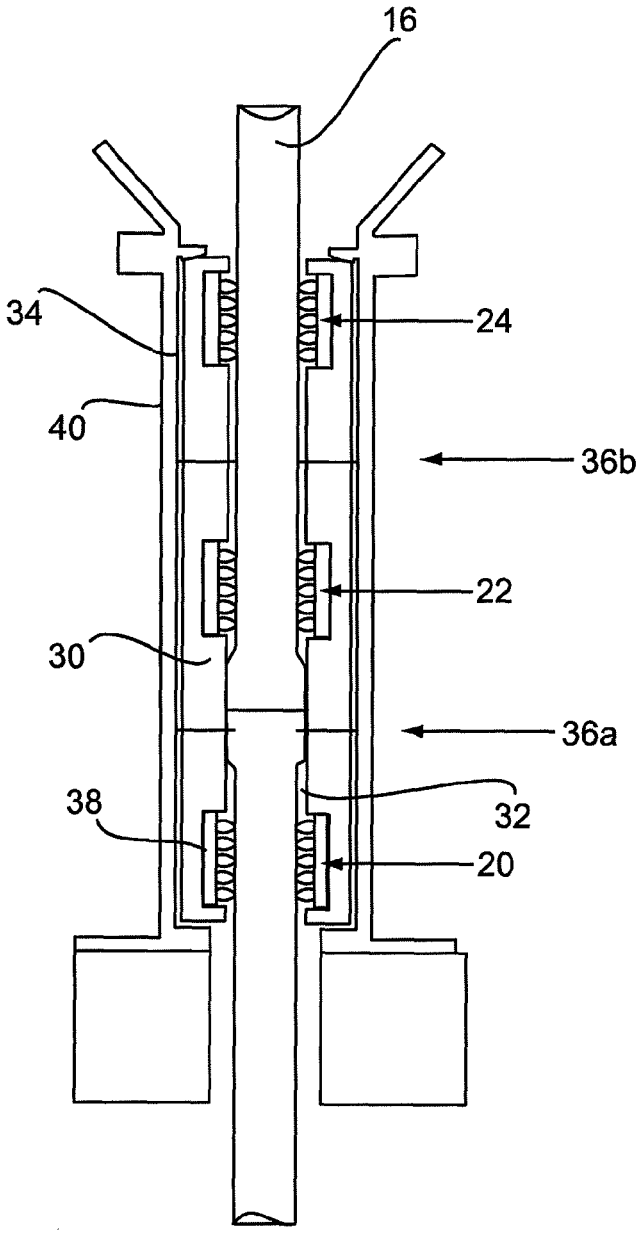
FIG. 3 shows an embodiment of the present sealing system in more detail with a uniform diameter of a drill stem that passes the sealing elements.

FIG. 3 shows an embodiment of the present sealing system in more detail, with uniform diameter on the drill stem that passes through. The sealing unit 30 is here shown locked into the receiver unit 40 and seals around the drill stem 16 that passes through a number of sets with main sealing elements 20,22,24 adapted to the drill stem that shall be used. In the example shown, three sets are used, but fewer or more can, of course, be used. In the elongated annular space 32,34 that is formed between the sets of sealing elements 20,22,24 preferably environmentally friendly grease or oil with the appropriate characteristics is injected with the help of suitable injection equipment. This injection equipment can comprise a variable number of units 36*a*-36*n*, of which two are referred to in FIGS. 3 and 4, respectively, as 36*a* and 36*b*.

The grease or oil will be injected with a pressure that is preferably higher than the highest pressure that surrounds the seal from the well or the surroundings, and will, in this way, ensure inflow of fluid or gas through the seal is prevented. In addition, grease or oil will give pressure support and lubrication to the sealing elements. Each of the sets of sealing elements can comprise a number of packing elements 38 in the form of sealing discs, where the seals are preferably formed in a plate form or dish form with a through opening. Other shapes of seals are, of course, also possible. Said seals in the sets of sealing elements can be made from elastomers, either through going or with internal pressure support. Other suitable composites with appropriate characteristics can also be used.

Figure 4:
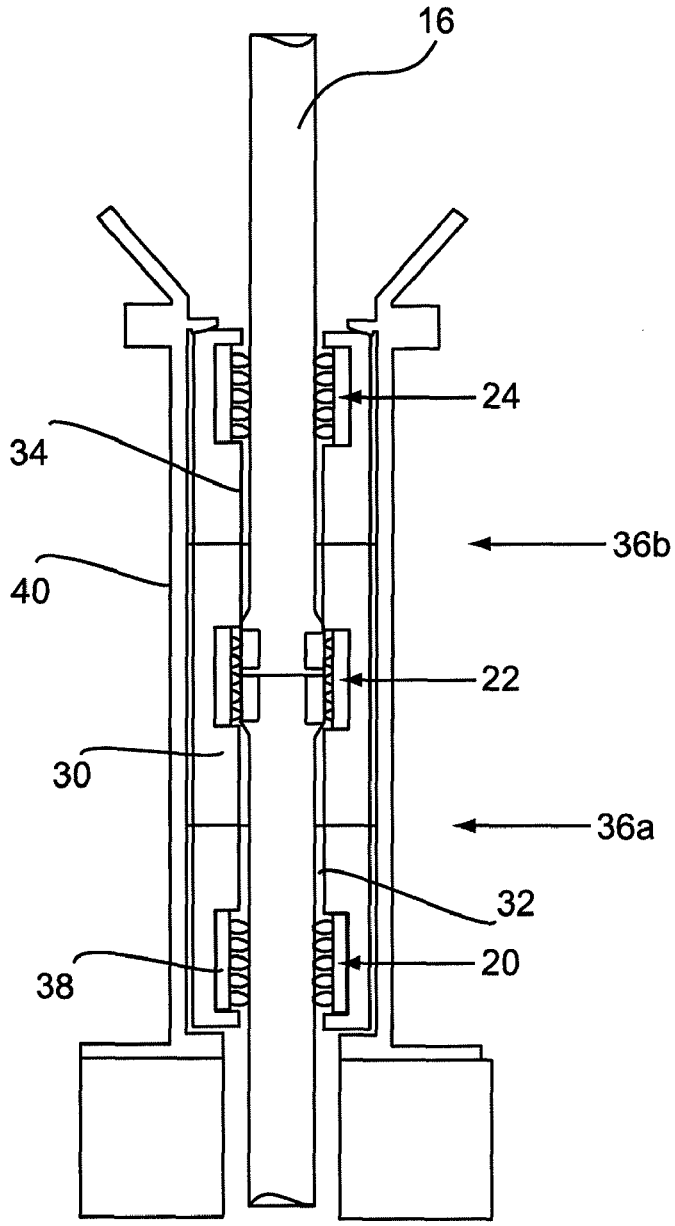
FIG. 4 shows an embodiment of the present sealing system in more detail, with a variable diameter of a drill stem that passes one of the sealing elements.

FIG. 4 shows an embodiment of the present sealing system in more detail, with variable diameter on the drill stem that passes through. The description is as in FIG. 3, with the exception that the pipe coupling of the drill stem or something else with an increased diameter passes through a sealing set. The sealing unit 30 is constructed in such a way that the area/length with increased diameter will, at any time, only be in contact with only one of the sealing sets at a time.

The invention claims is:

1. System for dynamic sealing around a drill stem (16) of a variable diameter in water carrying, drilling fluid carrying or hydrocarbon carrying wells, comprising a sealing arrangement (10) arranged for mounting to existing equipment on the well and for use with riserless systems, the sealing arrangement (10) comprises an elongated dynamic sealing unit (30) arranged to envelop the drill stem (16), and a receiver unit (40) mounted to said existing equipment on the well and which is arranged to receive the sealing unit (30), wherein internal pressure support is provided in the sealing arrangement (10), at least corresponding to the surrounding pressure, to provide a dynamic seal around the drill stem (16), by a pressure medium in defined annular spaces (32,34) between a number of sets of main seals (20,22,24), and said main seals (20,22,24) are arranged mutually spaced apart with a distance longer than the length of the pipe coupling in the drill stem (16), in the longitudinal direction of the sealing unit (30).

2. System according to claim 1, wherein each of said sealing sets (20,22,24) comprises at least one disc formed or ring formed packing element (38) of an elastic material, such as an elastomeric material, arranged to envelop said drill stem (16).

3. System according to claim 2, wherein an elongated annular space (32,34) is provided between the sets of sealing elements (20,22,24), in the longitudinal direction, arranged to receive injected pressure medium, such as grease or oil, through gates in the side (36*a*-36*b*), where the pressure medium is injected with a pressure that is preferably higher than the highest pressure that surrounds the sealing arrangement (10) from the well or the surroundings.

4. System according to claim 3, wherein a number of seals, such as elastomer seals (66*a*,66*b*,66*c*) are arranged between the sealing unit (30) and the receiver part (40) to seal between the sealing unit (30) and the receiver part (40).

5. System according to claim 1, wherein a number of seals, such as elastomer seals (66*a*,66*b*,66*c*) are arranged between the sealing unit (30) and the receiver part (40) to seal between the sealing unit (30) and the receiver part (40).

6. Method for mounting and use of a dynamic sealing arrangement (10) around a drill stem (16) of a variable diameter, in water carrying, drilling fluid carrying or hydrocarbon carrying wells, as a connecting string for downhole tools is led into the well through open sea, with a dynamic sealing unit (30) hooked on, without a riser or a landing string being mounted, to enter and be locked to a receiver part (40) that is mounted to existing equipment, wherein a pressure medium is injected in defined annular spaces (32,34) that lies between a number of sets of seals (20,22,24) in the sealing arrangement (10) to provide internal pressure support, at least corresponding to the surrounding pressure, and which is adjustable in the degree of sealing to seal between the well and the drill stem.

7. Method according to claim 6, wherein the pressure medium that is injected in said annular space (32,34) is grease, oil or another medium with a high pressure, to provide pressure support to the sealing arrangement so that this withstands pressure from both sides, and thus prevents the well medium from flowing out into the surroundings or that the surrounding medium flows into the well.

8. Method according to claim 7, comprising injection of grease or oil between the sealing sets (20,22,24) to prevent through flow of liquid or gases in the sealing arrangement (10), and/or to reduce the friction between the sealing sets (20,22,24) and the drill stem (16).

* * * * *